US007832124B2

(12) United States Patent
Blockton

(10) Patent No.: US 7,832,124 B2
(45) Date of Patent: Nov. 16, 2010

(54) VIBRATORY SHOE FOR FEET

(76) Inventor: Deborah Blockton, 5225 Idaho St., St. Louis, MO (US) 63111

( * ) Notice: Subject to any disclaimer, the term of this patent is extended or adjusted under 35 U.S.C. 154(b) by 340 days.

(21) Appl. No.: 11/616,668

(22) Filed: Dec. 27, 2006

(65) Prior Publication Data

US 2008/0161734 A1 Jul. 3, 2008

(51) Int. Cl.
*A43B 23/00* (2006.01)

(52) U.S. Cl. ..... 36/136; 36/137

(58) Field of Classification Search ..... 36/136, 36/137, 141

See application file for complete search history.

(56) References Cited

U.S. PATENT DOCUMENTS 3,731,674 A * 5/1973 Parvin ..... 601/30
4,802,463 A 2/1989 Rojas
5,113,850 A 5/1992 Larremore
5,285,586 A * 2/1994 Goldston et al. ..... 36/137
5,592,759 A * 1/1997 Cox ..... 36/141
5,692,324 A * 12/1997 Goldston et al. ..... 36/137
5,836,899 A * 11/1998 Reilly ..... 601/46
5,913,838 A * 6/1999 Reilly ..... 601/58
6,464,654 B1 10/2002 Montgomery
7,210,253 B2 * 5/2007 Yu ..... 36/141
7,347,831 B2 * 3/2008 Chiu ..... 601/15
7,497,037 B2 * 3/2009 Vick et al. ..... 36/137
2005/0126049 A1 * 6/2005 Koenig ..... 36/141
2006/0174522 A1 * 8/2006 Yu ..... 36/141
2006/0230641 A1 * 10/2006 Vick et al. ..... 36/137
2007/0260421 A1 * 11/2007 Berner et al. ..... 702/160

* cited by examiner

*Primary Examiner*—Marie Patterson
(74) *Attorney, Agent, or Firm*—Charles McCloskey

(57) ABSTRACT

A shoe incorporates reflexology and acupressure as applied to a foot when wearing the shoe. The shoe has a sole with a battery powered vibration unit that mechanically vibrates a spiked gel insole located near the underside of a foot. The rounded spikes of the insole stimulate the acupressure points of the foot for its relaxation and pleasant feelings in a person. The sole of the shoe has a port for battery charging, a switch to control the vibration, and a charge indicator light at the sole's edge. The sole has a latch to remove the battery from a compartment in the heel area. The vibrating shoe operates while bearing the weight of a person or not. A transmitter remotely activates the vibration unit as a person is standing.

5 Claims, 5 Drawing Sheets

VIBRATORY SHOE FOR FEET

BACKGROUND OF THE INVENTION

The vibratory shoe for feet generally relates to therapeutic footwear and more specifically to a shoe with a vibrating sole controlled remotely by the wearer.

For people, the feet endure much abuse over a lifetime in various activities. The feet support the weight of a person and absorb the impact from walking, running, or moving. Feet also remain within socks and shoes for many hours. When in socks and shoes, feet sweat and produce unhealthy conditions. Feet sometimes develop odors, fungi, such as athlete's foot or jungle rot, ingrown toe nails, dry skin, and cracked skin, among other conditions. Those afflicted with diabetes may also develop foot conditions requiring medicinal treatment. Early treatment of a foot in a diabetic lowers the risk of amputation of the foot.

For a diabetic with a foot condition or a person with a tired foot, vibration to the foot, particularly the sole, soothes the condition and relaxes the foot. The vibration induces the sensation of motion to small portions of the sole which triggers positive feelings from reflexology points upon the foot. Vibration can be supplied when the foot is at rest and elevated or when the foot is active and a person is on her feet.

Pin point massage, upon parts of the body as in feet, has its roots from acupuncture, a form of therapy and health maintenance developed by the Chinese over the last forty centuries. Presently, members of the public, the media, and some scientific institutions widely believe that acupressure massage affects the energy balance in the human body and that it activates natural self-healing abilities. The energy within the body travels upon lines that manifest in specific locations upon the surface of the body. Pressure applied at those specific locations affects the energy balance within the body beneficially. A daily pressure point massage may sooth many common ailments, promote overall health and well-being, and ease sore feet. The therapeutic effects of an acupressure massage relax and comfort a sore foot and stave off the effects of disease. Studies have shown that massage has a positive effect on people in reducing pain and stress. Specifically, massage triggers certain physiological changes in people, such as improved immune function, better sleeping habits, less irritability, and comfortable feet.

DESCRIPTION OF THE PRIOR ART

Feet have received vibration through shoes over the years. Common insoles with an array of nodules stimulate the sole of a foot as a person moves while wearing a shoe including the insole. Shoes have also imparted a vibration to the foot mechanically using various devices.

For example, the patent to Parvin U.S. Pat. No. 3,731,674 shows an early shoe for muscle relaxation. This patent shows a dress shoe with a chamber in the heel holding two motors and a battery. A switch extends from the heel to activate the motors. The motors cause vibration when they rotate in opposite phase to one another. Unlike the present invention, this patent lacks an indicator light, rechargeable batteries, and a vibrating insole.

The patent to Rojas U.S. Pat. No. 4,802,463 shows a foot massage device powered by a motor with an eccentric, or lopsided, wheel. The wheel induces lengthwise vibrations into the upper part of a sole. The vibrations are carried through four transmitting members while the motor is powered by external batteries. Similar to the present invention, this massage device induces vibration into the sole mechanically on battery power. Unlike the present invention, this device has external power, no gel insole, and no indicator light.

The patent to Larremore et al., U.S. Pat. No. 5,113,850, shows a massaging shoe that has an external battery pack for powering a vibrating plate. The sole has a switch upon the side that regulates delivery of electricity to the plate. As in the present invention, this shoe vibrates a foot by a device, here a plate, placed in the sole and has a switch in the sole. In contrast to the present invention, this shoe has external batteries mounted upon the heel of the shoe.

The patent to Cox, U.S. Pat. No. 5,592,759 describes another vibrating shoe that has a motor with batteries located within a cavity in the sole. The motor is turned on through a switch generally located through the heel of the sole. However, rechargeable batteries, an indicator light, and a spiked insole are not disclosed.

The patent to Reily, U.S. Pat. No. 5,836,899 has a system for causing massage in footwear. This system has a power supply, switch, and wiring mounted upon the tongue of a shoe, likely an athletic shoe. The system induces vibration through vibrating devices mounted within the sole of the shoe. This system though lacks a spiked or gel insole, an indicator light, and recharging capability for the batteries.

Mr. Reilly has a second patent, U.S. Pat. No. 5,913,838 for a vibrating insole of two layers with a vibrator located between the layers. An external battery powers the vibrators and has a retractable cord. The present invention though has the sole vibrating, batteries within the sole, and fixed wiring between the batteries and the motor. This patented insole does claim a gel like material for the upper layer of the insole. With retractable wiring and external batteries, this patent does not disclose the present invention except for the claim to gel material.

The patent to Montgomery et al., U.S. Pat. No. 6,464,654 shows another shoe massager. This shoe has a vibrator and batteries located in the sole generally near the heel. The vibrator is turned on by a switch located in the heel itself, likely a tap by the other shoe. This patented shoe though has a perimeter wall that nearly covers the wearer's foot which the present invention does not have.

And, the publication to Koenig No. 2005/0126049, has a soft sided vibrating fabric shoe. As in the previous shoes, this publication has a battery powered motor that vibrates a sole. This publication specifies the location of the vibrator as in the mid arch area, the sole as transmitting vibrations, and an access door for the batteries. This publication lacks the rechargeable batteries of the present invention, an indicator light, and the spiked insole.

The present invention overcomes the difficulties of bending down to turn on a vibrating shoe and to replace batteries. The prior art describes switches located near the heel portion of a sole that a wearer activates by bending at the waist so the arms may reach the switch. The present invention though has an antenna to receive signals from a remote transmitter so a wearer of the invention may activate the vibration units while standing.

SUMMARY OF THE INVENTION

Generally, the present invention is a shoe incorporating reflexology and acupressure applied to a foot. The shoe has a sole with a miniature battery powered vibration unit that induces vibration into a spiked gel insole. The vibration unit contacts the spiked insole to transmit vibrations mechanically to the underside of a foot, or sole. The rounded spikes of the insole stimulate the acupressure points of the foot leading to relaxation of the foot and more pleasant feelings in a person. The sole of the shoe has a port for battery charging, a switch to control the vibration, and a charge indicator light at the sole's edge. The sole has a latch upon a door to remove the battery from a compartment in the heel area of a sole. The switch and plug are protected by elastomeric covers to prevent contamination by moisture and dirt. The vibrating shoe operates while bearing the weight of a person and when not bearing it. A radio transmitter allows for remote activation of the vibration unit, particularly as a person is standing while wearing the present invention.

There has thus been outlined, rather broadly, the more important features of the invention in order that the detailed description thereof that follows may be better understood and that the present contribution to the art may be better appreciated. The present invention also includes variations in battery location, insole construction, and a piezo electric power source. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

Therefore it is an object of the present invention to provide a vibrating shoe that induces massage to the sole of a foot.

Another object is to provide such a shoe that activates the vibration without a person having to bend down to the shoe.

Another object is to provide such a shoe with rechargeable batteries to lessen the instance of exchanging batteries from the shoe.

Another object is to provide such a shoe with a piezo electric source so that electric power is provided to the vibrating unit by the footfalls of a person wearing the shoe.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
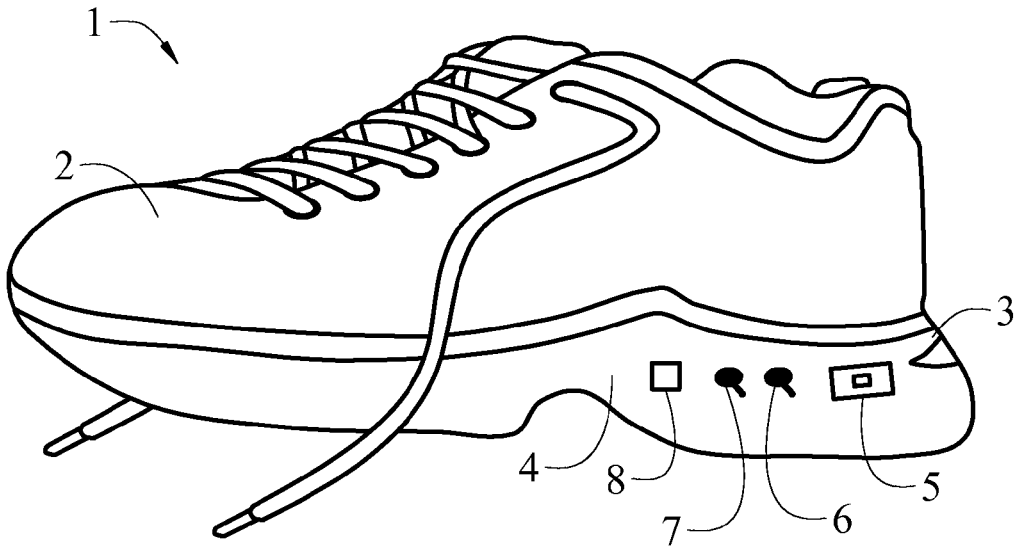
FIG. 1 shows a side view of the present invention.

The present invention of a vibrating shoe overcomes the prior art limitations by providing remote activation of vibration units, charge status of batteries, and exterior location of batteries. For tired feet or feet subject to a condition, the present invention seeks to provide relaxation using the device beginning with FIG. 1. The present invention 1 is generally a shoe 2, preferably athletic, that has a heel 3 and a sole 4 with thickness or a single piece sole as further described. The present invention can be applied to both shoes in a pair though only a left shoe is shown for clarity. The present invention has a switch 5, a sensible indicator or a charge status light 6, and a charging port 7 located on the exterior of the sole, near the heel of the wearer's foot. An antenna 8 is also located proximate the switch. The switch regulates delivery of electrical power to vibration units, later shown in FIGS. 3, 4. The switch can be a slider, toggle, push button, and the like. The switch provides for a wearer to activate the vibrating shoe with the touch of a finger, though while bending down to the shoe, or a tap from the other foot.

Figure 3:
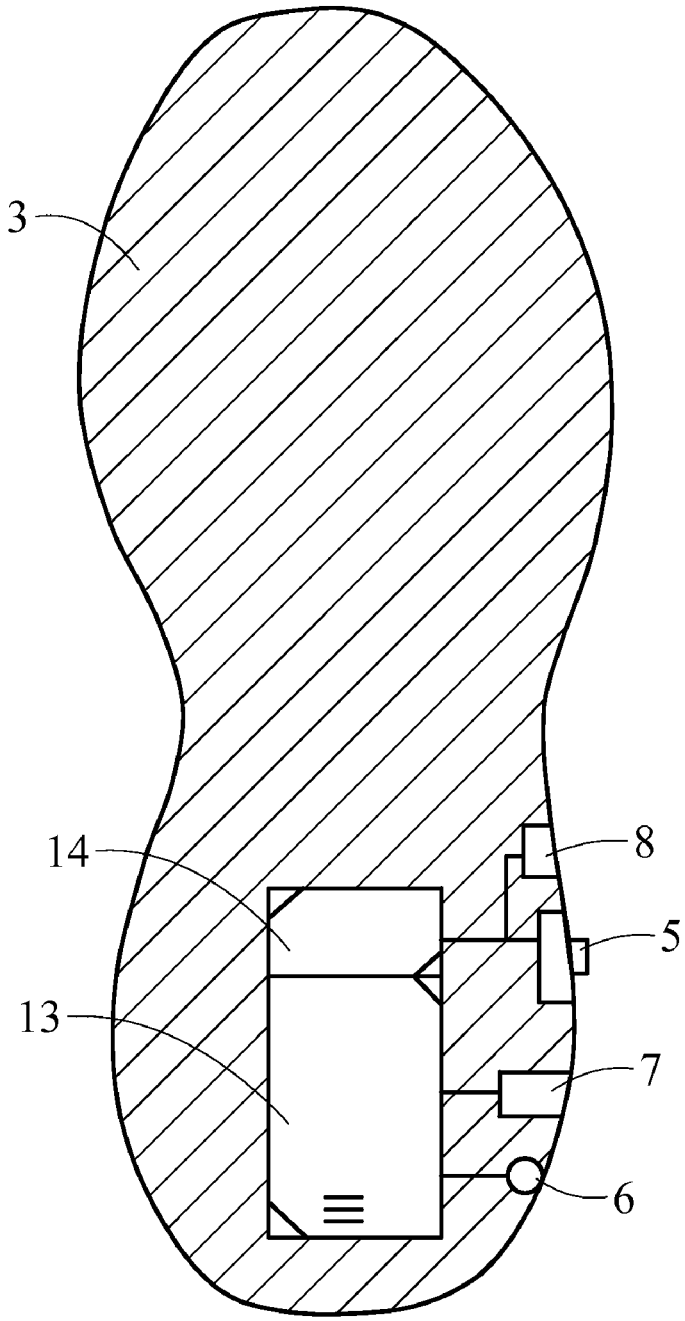
FIG. 3 shows a plan view of the sole revealing the electrical components of the present invention.

The charge status light indicates the condition of a rechargeable battery located within the sole, see FIG. 3. The charge status light emits a red light when the battery is recharging and then a green light when the battery is fully recharged. The charge status light is preferably a Light Emitting Diode, LED, or alternatively a rugged small incandescent bulb. Near the charge status light, a charging port receives the male end of a cable from a transformer, not shown, and delivers electrical charge to the battery. The charging port is generally a round and female.

Proximate the switch is also located an antenna for reception of signals, such as radio and infra red, from a remote transmitter. The antenna is in the same circuit as the switch and provides operational commands to the vibration unit. The lightweight rugged antenna permits a person to activate the vibrating shoe without bending down to manually activate the switch. The antenna receives electromagnetic radiation, such as infra red light, laser light, and radio. Remote activation has proven useful to diabetics and other persons unable to bend and touch their shoes.

Figure 2:
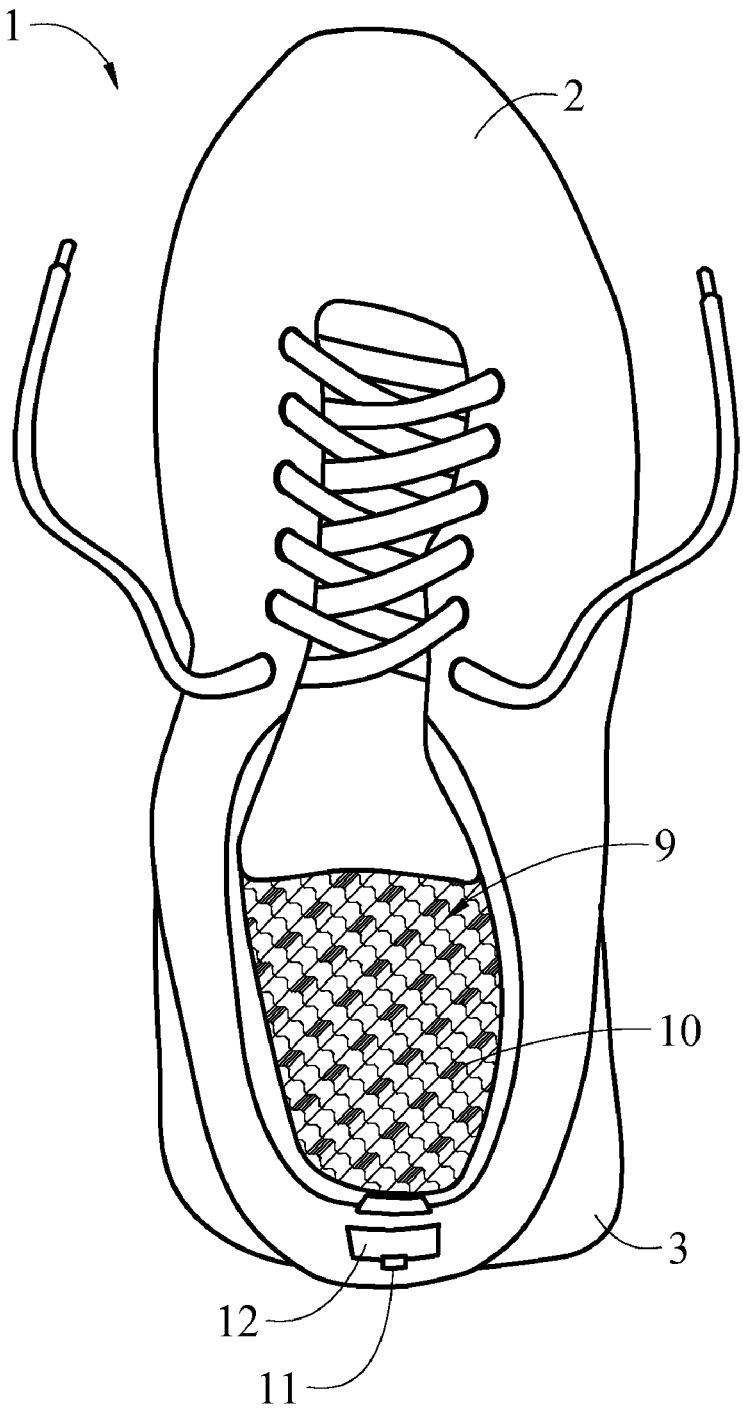
FIG. 2 shows a top view of the present invention particularly the first end and the second end.

While the shoe vibrates, the vibration massages the sole of a foot using an insole 9 shown in FIG. 2. The insole is gel filled, has rounded spikes 10 extending upwards from the insoles, and has the shape of the inside of the shoe. The rounded spikes direct forces from the vibration unit to points upon the bottom of a wearer's foot. The vibrations applied at those points trigger pleasant and relaxing feelings for the person using the principles of reflexology. Upon the heel, shown outside of the insole, the shoe has a latch 11 upon the exterior of the sole above a door 12 for insertion of a battery 13 into a compartment within the shoe, here particularly in the sole. Pressing of the latch releases the door to fold downwards and reveal the battery for removal or permit installation of the battery.

FIG. 3 shows the components of the vibrating shoe contained generally within the sole 4 that operate the invention 1. The sole contains one or more rechargeable batteries 13 with sufficient capacity to power a vibration unit 14. As a shoe bears a significant portion of a person's weight, vibration calls for significant energy to be created. Though alkaline batteries can be used, the power demand upon the batteries will quickly exhaust alkaline batteries. Facing high demand, a rechargeable battery minimizes costs to the wearer. Ahead of the battery towards the ball of the foot, a vibration unit induces vibration into the sole and onward into the shoe upon application of power from the manual switch or upon command of the remote control. The vibration unit is similar to the mechanism used in cell phones and pagers to induce vibration of those devices. The battery is in further communication with a charge port 7, here shown upon the exterior edge of the sole and with a charge status light 6 shown adjacent to the charge port. The charge port receives the cable (not shown) from a transformer to charge the battery while the charge status light indicates when charging is in progress and its completion. The charge status light is capable of displaying multiple colors, including red and green. Proximate the switch, the sole houses the antenna 8 for receipt of signals, such as radio, laser light, and infra red light, from the remote transmitter. The commands from the antenna override the switch so that a person can activate and deactivate the vibration unit from a standing position, or without bending to touch the shoe.

Alternatively, the invention is powered by a piezo electric generator that creates electric current each time the shoe bears weight. The piezo electric generator can supply power directly to the vibration units or to recharge a battery 13 that itself powers the vibration units. Additionally, the sensible indicator can be a sound generator, such as a beeper, in lieu of a charge status light.

Figure 4:
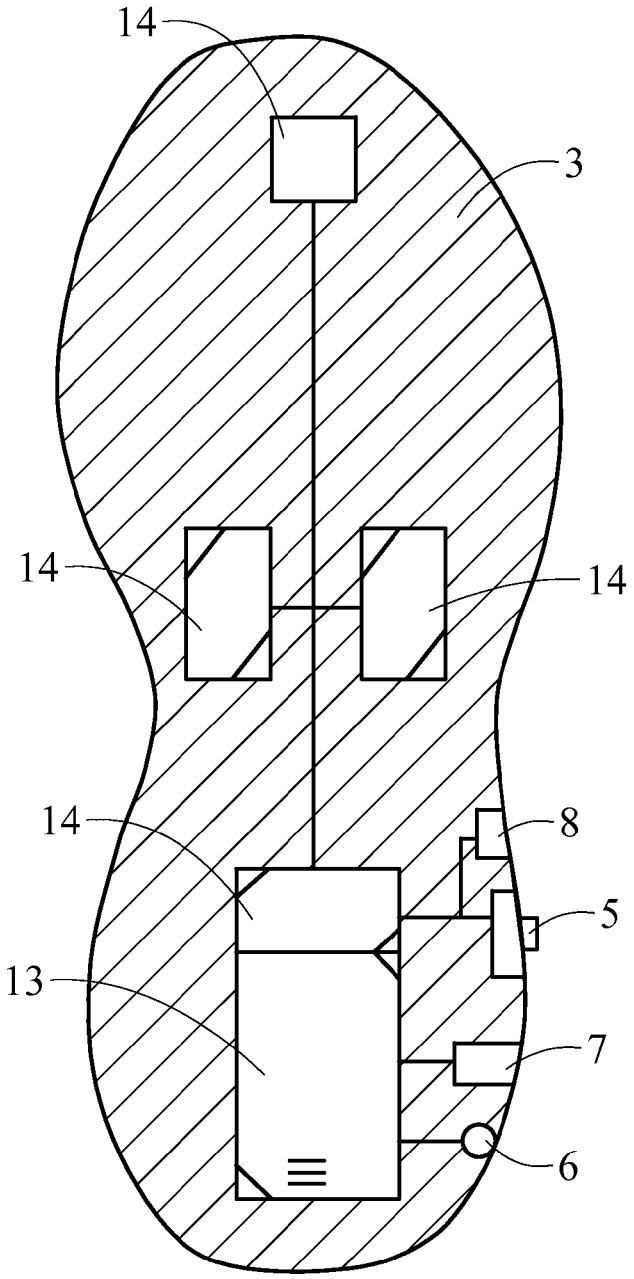
FIG. 4 illustrates a sectional view through the sole showing an alternate arrangement of vibration units; and, FIG. 5 describes a rear view of an alternate embodiment for the battery location.

FIG. 4 describes an alternate embodiment of the present invention where the vibration unit 14 has four components spaced about the sole. The components produce approximately one fourth the vibration of the vibration unit shown in FIG. 3. The components are commonly wired into the same electrical circuit for activation by the switch or remotely through the antenna. The components are generally located one in the heel vicinity, one in the ball of the foot area, and two spaced apart and centered in the arch area of the sole. The components provide vibration to targeted locations upon the bottom of a foot.

Figure 5:
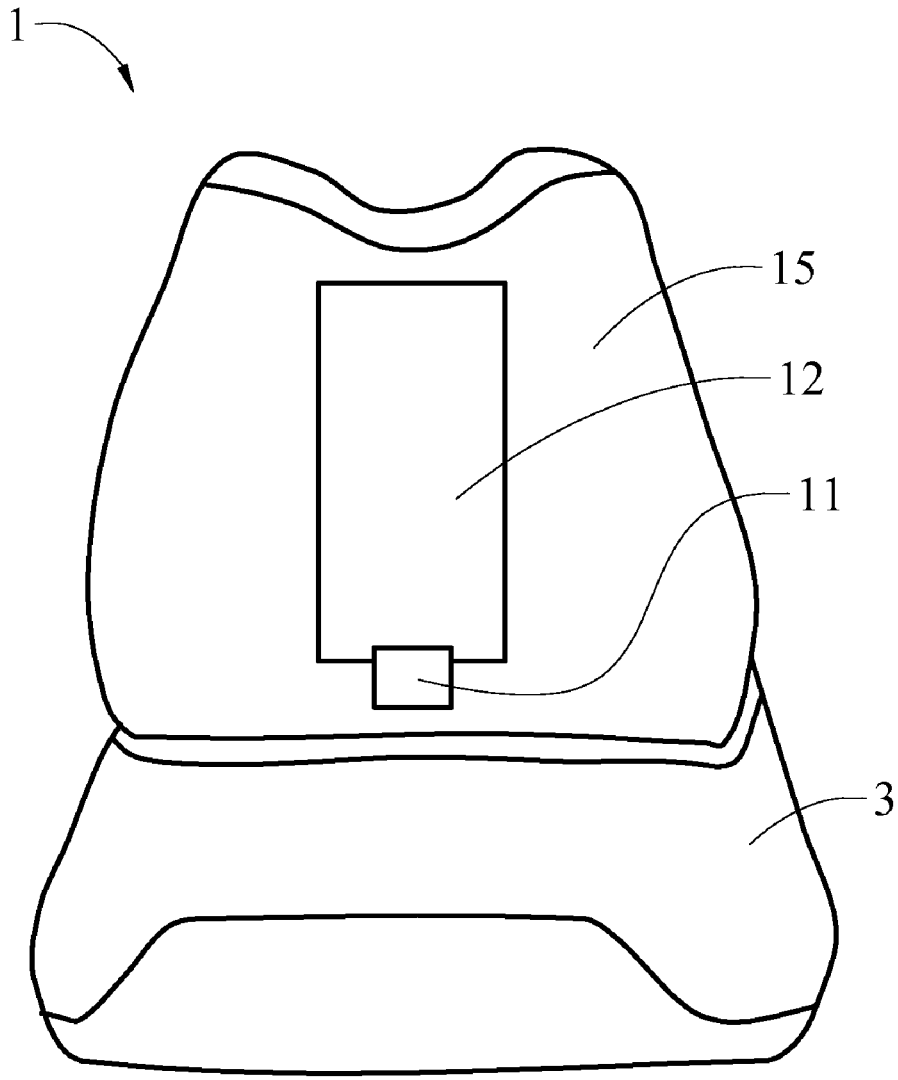

And FIG. 5 shows an alternate embodiment of the present invention where the battery is stored outside of the sole. Here, the battery 13 is stored upright within the heel counter 15, generally behind a latched door. The door 12 pivots upon a hinge located at the top towards the ankle of the wearer and has a latch 11 upon the bottom towards the sole. The battery is wired to the remainder of the invention still contained within the sole as shown previously in FIG. 3. The door generally has the same planar shape as the battery.

From the aforementioned description, a vibrating shoe for feet has been described. The vibrating shoe is uniquely capable of soothing and relaxing feet while the operator remains standing. The vibration unit is made from rugged electronics or piezo-electrics. The vibrating shoe and its various components may be manufactured from many materials, including but not limited to, polymers, polyvinyl chloride, high density polyethylene, polypropylene, nylon, steel, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A shoe for massaging, soothing, relaxing a foot of a person wearing said shoe, said shoe having a sole, a counter above said sole, and an upper above said sole and forward of said counter comprising:

a vibration unit lacting within said sole;

a power source supplying electricity to said vibration unit;

a switch regulating said power source and said vibration unit;

an antenna cooperating with said switch and thus regulating said power source and said vibration unit;

a remote transmitter for activation and deactivation of said vibration unit in cooperation with said antenna, said battery being rechargeable;

wherein said power source is a battery;

a charging port, accessible upon the perimeter of said sole and in communication with said battery; and, a charge status indicator, sensible upon the perimeter of said sole and in the same circuit as said battery.

2. The massaging shoe of claim 1 wherein said charge status indicator is a light emitting diode.

3. The massaging shoe of claim 2 wherein said light emitting diode emits multiple colors.

4. The massaging shoe of claim 1 wherein said charge status indicator is a sound generator.

5. A shoe for massaging, soothing, relaxing a foot of a person wearing said shoe, said shoe having a sole, a counter above said sole, and an upper above said sole and forward of said counter comprising:

a vibration unit lacting within said sole;

a power source supplying electricity to said vibration unit;

a switch regulating said power source and said vibration unit;

an antenna cooperating with said switch and thus regulating said power source and said vibration unit;

a remote transmitter for activation and deactivation of said vibration unit in cooperation with said antenna, said battery begin rechargeable;

wherein said rower source is a battery;

a door for releasably securing said battery within said shoe; and, a latch for opening said door;

said shoe having a heel, locating generally towards the rear; and, said door hingedly connecting to said counter and extending generally vertically upon said counter proximate the heel of said shoe.

* * * * *